US008322314B2

(12) United States Patent
Kim

(10) Patent No.: US 8,322,314 B2
(45) Date of Patent: Dec. 4, 2012

(54) BOILER FURNACE THAT AVOIDS THERMAL NOX

(76) Inventor: Byung-Doo Kim, Seoul (KR)

( * ) Notice: Subject to any disclaimer, the term of this patent is extended or adjusted under 35 U.S.C. 154(b) by 1196 days.

(21) Appl. No.: 11/681,785

(22) Filed: Mar. 4, 2007

(65) Prior Publication Data

US 2007/0186828 A1 Aug. 16, 2007

(30) Foreign Application Priority Data

Sep. 7, 2004 (KR) ..... 10-2004-0071483
Sep. 7, 2005 (WO) ..... PCT/KR2005/002957

(51) Int. Cl.
*F22B 37/10* (2006.01)

(52) U.S. Cl. ..... 122/235.28; 122/235.23; 122/251

(58) Field of Classification Search ..... 122/1 B, 122/6 A, 11, 12, 84, 85, 116, 235.28, 249, 122/252, 235.23, 251, 235.12, 240.3
See application file for complete search history.

(56) References Cited

U.S. PATENT DOCUMENTS 828,898 A * 8/1906 Norwood ..... 122/251
2,748,754 A * 6/1956 Otto Lotz ..... 122/235.28
2,793,626 A * 5/1957 Hubel ..... 122/235.28
2,796,051 A * 6/1957 Throckmorton et al. ..... 122/322
2,914,386 A * 11/1959 Shapleigh ..... 422/189
3,855,071 A * 12/1974 Koppelman ..... 202/121
4,615,715 A 10/1986 Seshamani
4,672,900 A * 6/1987 Santalla et al. ..... 110/264
4,721,454 A * 1/1988 Schirmer et al. ..... 431/10
4,746,337 A * 5/1988 Magol et al. ..... 55/434.1
4,825,813 A * 5/1989 Yoshinari et al. ..... 122/6 A
4,879,959 A * 11/1989 Korenberg ..... 110/264
4,900,246 A * 2/1990 Schirmer et al. ..... 431/352
4,909,191 A * 3/1990 Le Mer ..... 122/18.4
4,951,612 A 8/1990 Gorzegno
5,123,361 A * 6/1992 Nieh et al. ..... 110/264
5,226,936 A * 7/1993 Garkawe ..... 55/434.4
5,242,294 A 9/1993 Chato
5,273,209 A * 12/1993 MacArthur et al. ..... 237/18
5,315,939 A * 5/1994 Rini et al. ..... 110/264

(Continued)

FOREIGN PATENT DOCUMENTS

CN 86101227 9/1986

(Continued)

OTHER PUBLICATIONS

Office Action issued by the Korean Intellectual Property Office for the corresponding Korean application 10-2004-0071483; Mar. 29, 2006.

(Continued)

*Primary Examiner* — Gregory A Wilson
(74) *Attorney, Agent, or Firm* — Kevin J. McNeely; McNeely, Hare & War LLP

(57) ABSTRACT

A boiler furnace avoids NOx and increases thermal efficiency with a small boiler. The boiler furnace has a outer water walls and inner water walls. All of the water walls contain water which absorb heat from the flame and cool the water tube which act as a container, passage, evaporator of water and water walls with membrane that connect water tubes to each other. The spaces between outer water walls and inner water walls makes a cylindrical space which contain fires and avoids making a fire that produces nitrogen oxides due to high temperature induced from a concentrated flame.

4 Claims, 13 Drawing Sheets

U.S. PATENT DOCUMENTS

| | | | | |
|---|---|---|---|---|
| 5,791,299 | A * | 8/1998 | Matsuo et al. | 122/367.1 |
| 6,116,196 | A * | 9/2000 | Watanabe et al. | 122/235.11 |
| 6,269,782 | B1 * | 8/2001 | Kayahara et al. | 122/235.11 |
| 6,318,305 | B1 * | 11/2001 | Takubo et al. | 122/235.11 |
| 7,168,949 | B2 * | 1/2007 | Zinn et al. | 431/350 |
| 2003/0013059 | A1 * | 1/2003 | Dutescu et al. | 431/202 |
| 2007/0275335 | A1 * | 11/2007 | Biscan et al. | 431/160 |

FOREIGN PATENT DOCUMENTS

| | | |
|---|---|---|
| CN | 1272605 | 11/2000 |
| EP | 0786624 | 7/1997 |
| JP | 62178802 | 8/1987 |
| JP | 02-075805 | 3/1990 |
| KR | 1981-0002258 | 2/1981 |
| KR | 2001-0021146 | 3/2001 |
| KR | 10-2002-0039130 | 5/2002 |
| SU | 909475 | 2/1982 |

OTHER PUBLICATIONS

Decision to Grant issued by the Korean Intellectual Property Office for the corresponding Korean application Oct. 2004-0071483; Sep. 10, 2007.

Office Action issued by the Russian Federal Institute for Industrial Property for the corresponding Russian application 2007104686/06(005047); Jun. 20, 2008.

* cited by examiner

-- Prior Art --

-- Prior Art --

[FIG 2]
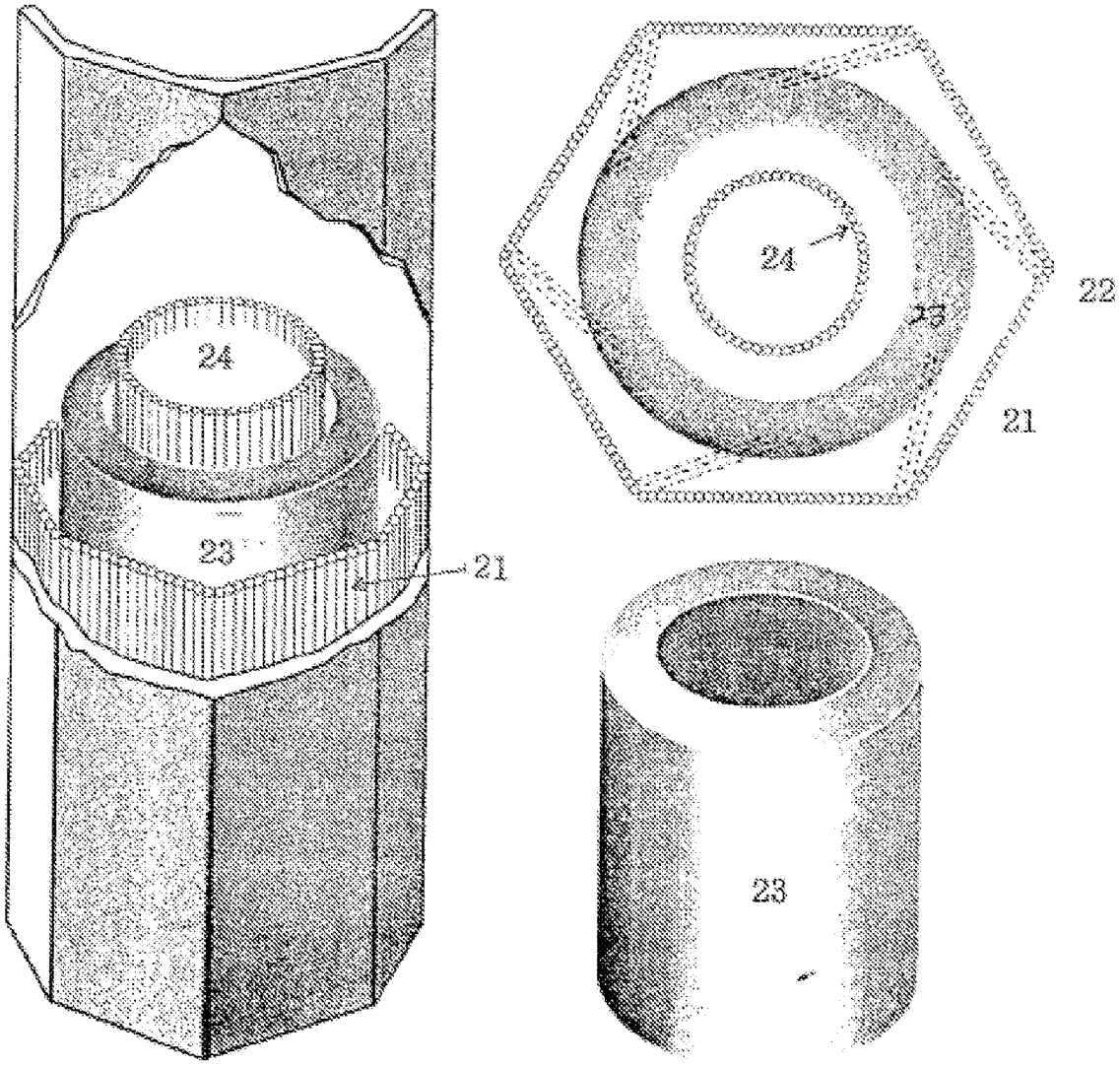

[FIG 3]
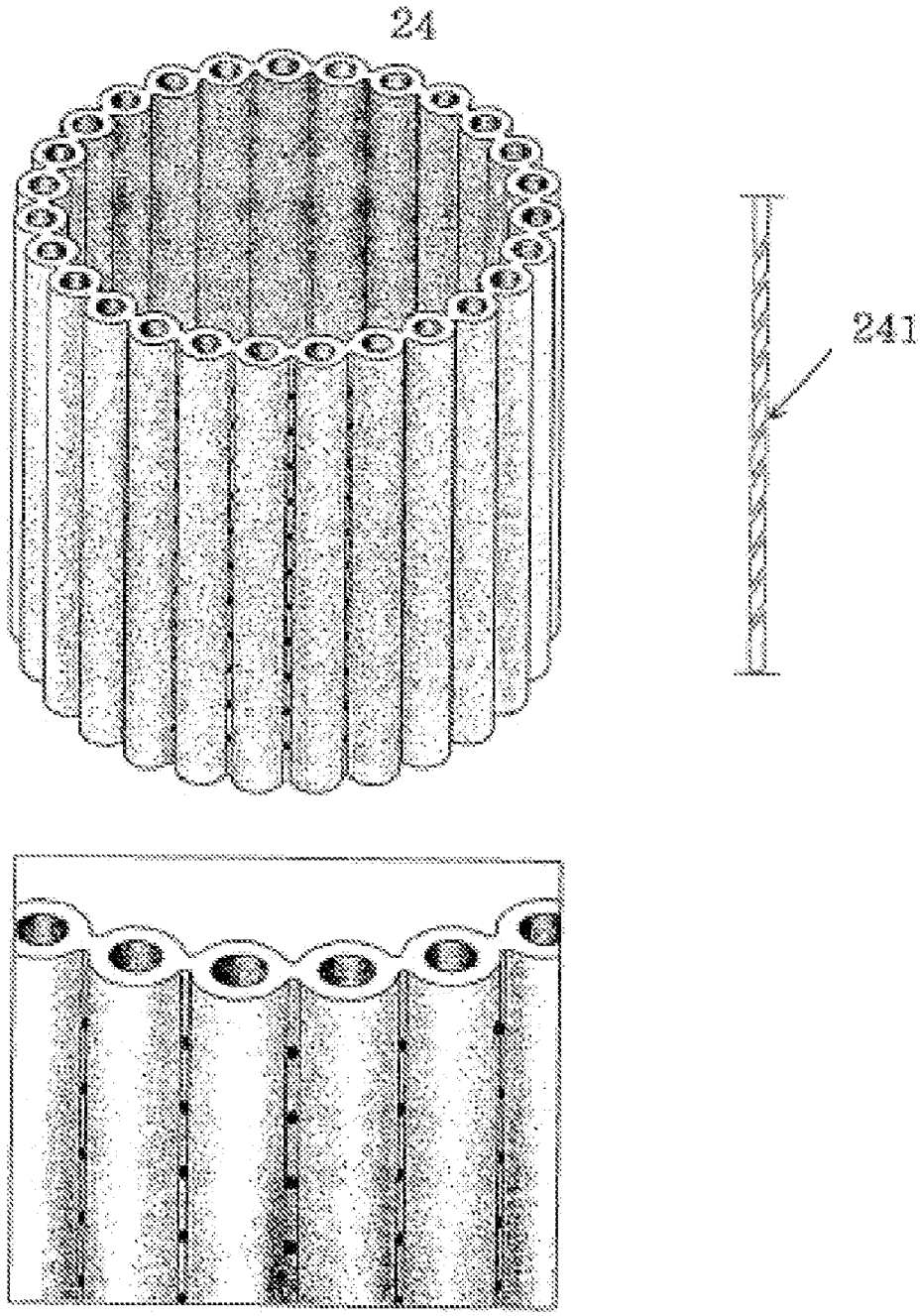

[FIG 4]
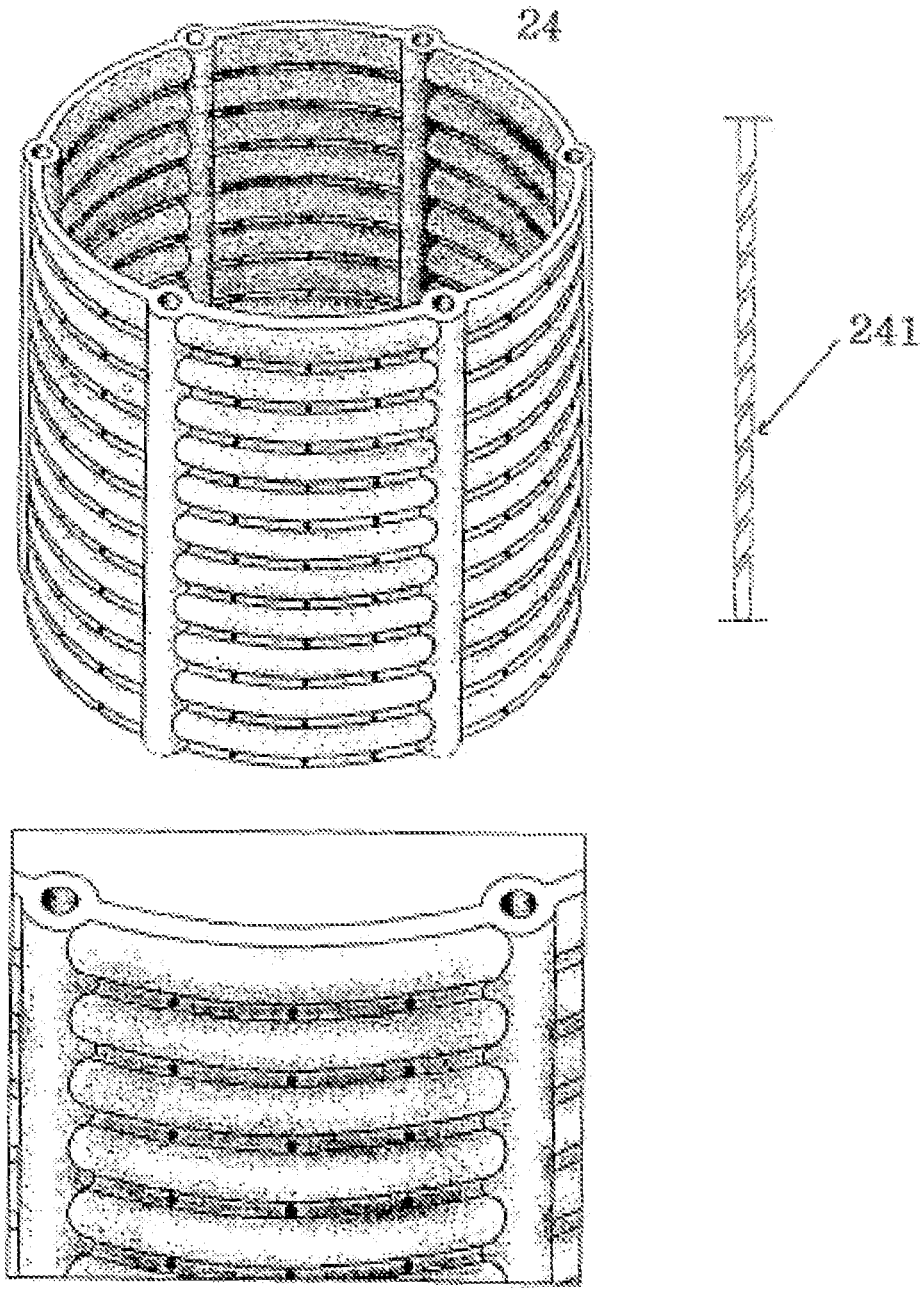

[FIG 5]
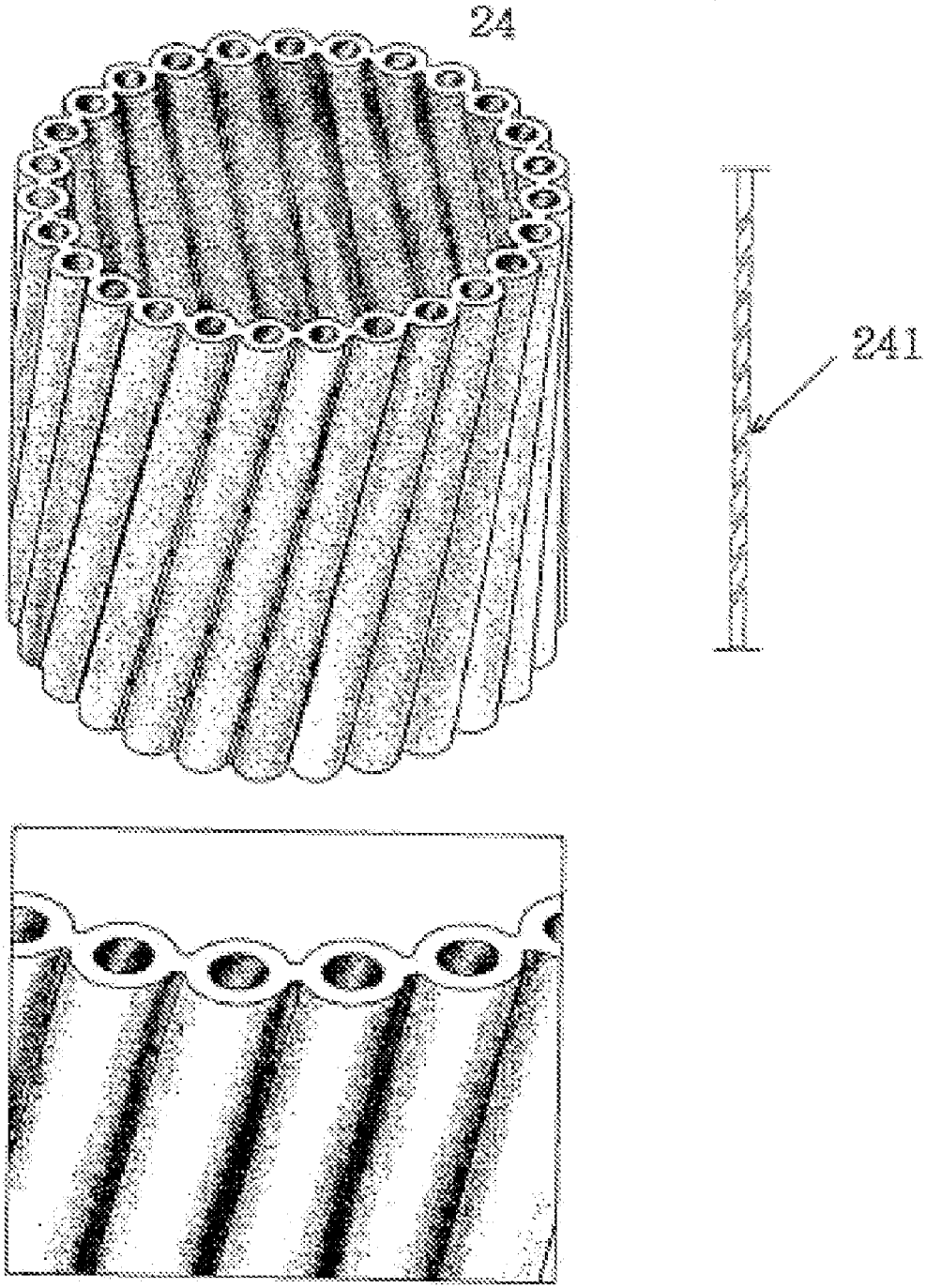

[FIG 6]
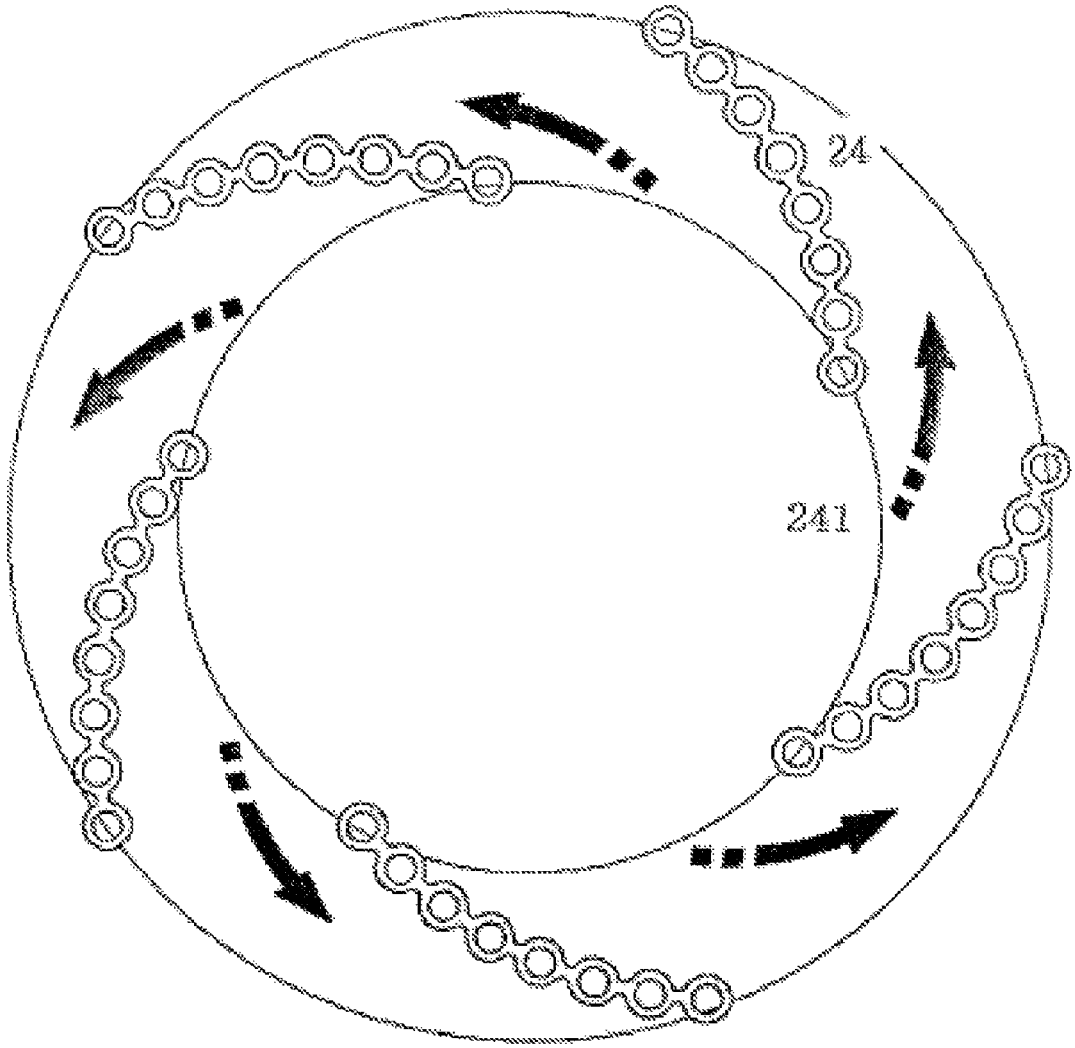

[FIG 7]
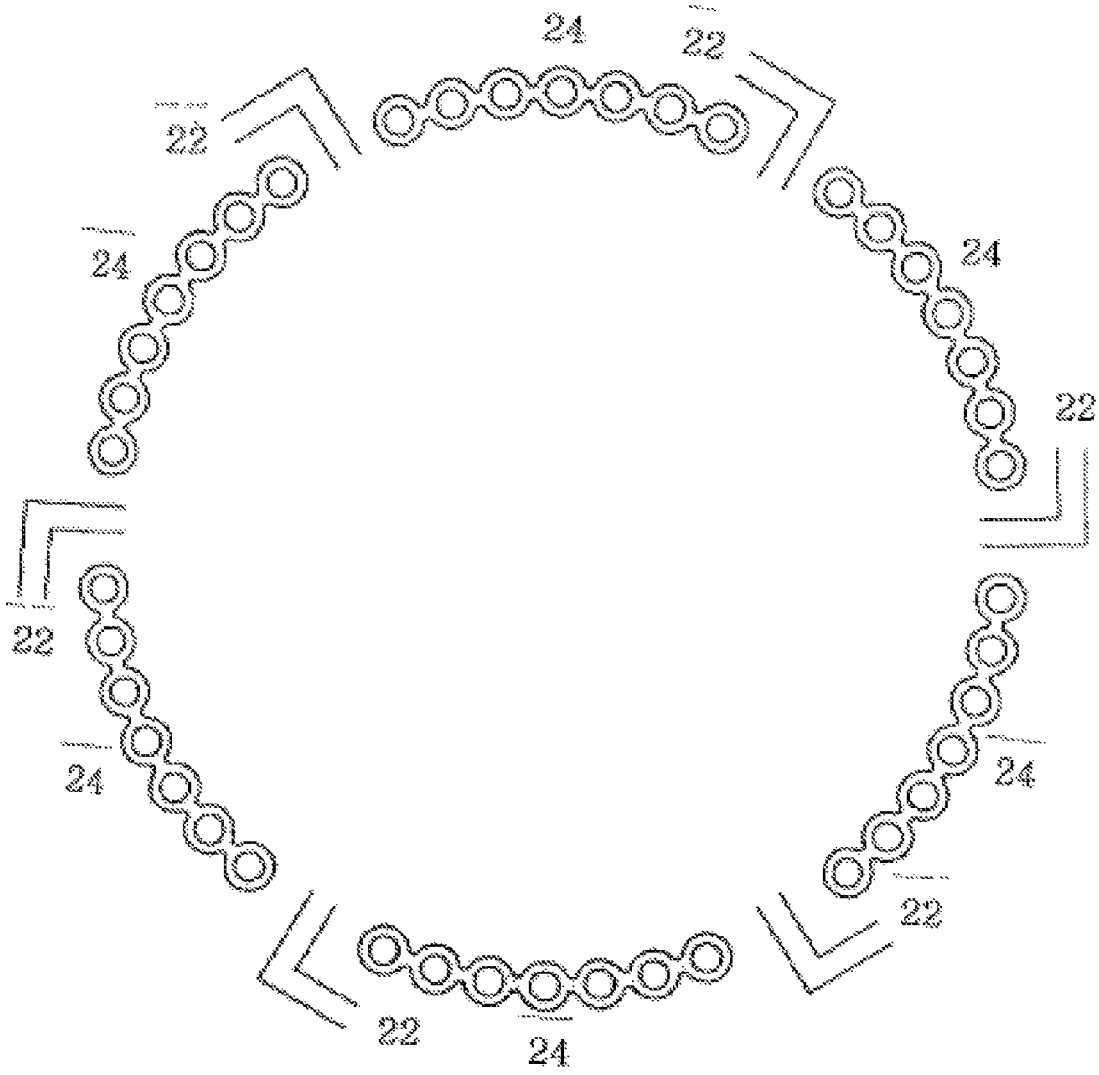

[FIG 8]
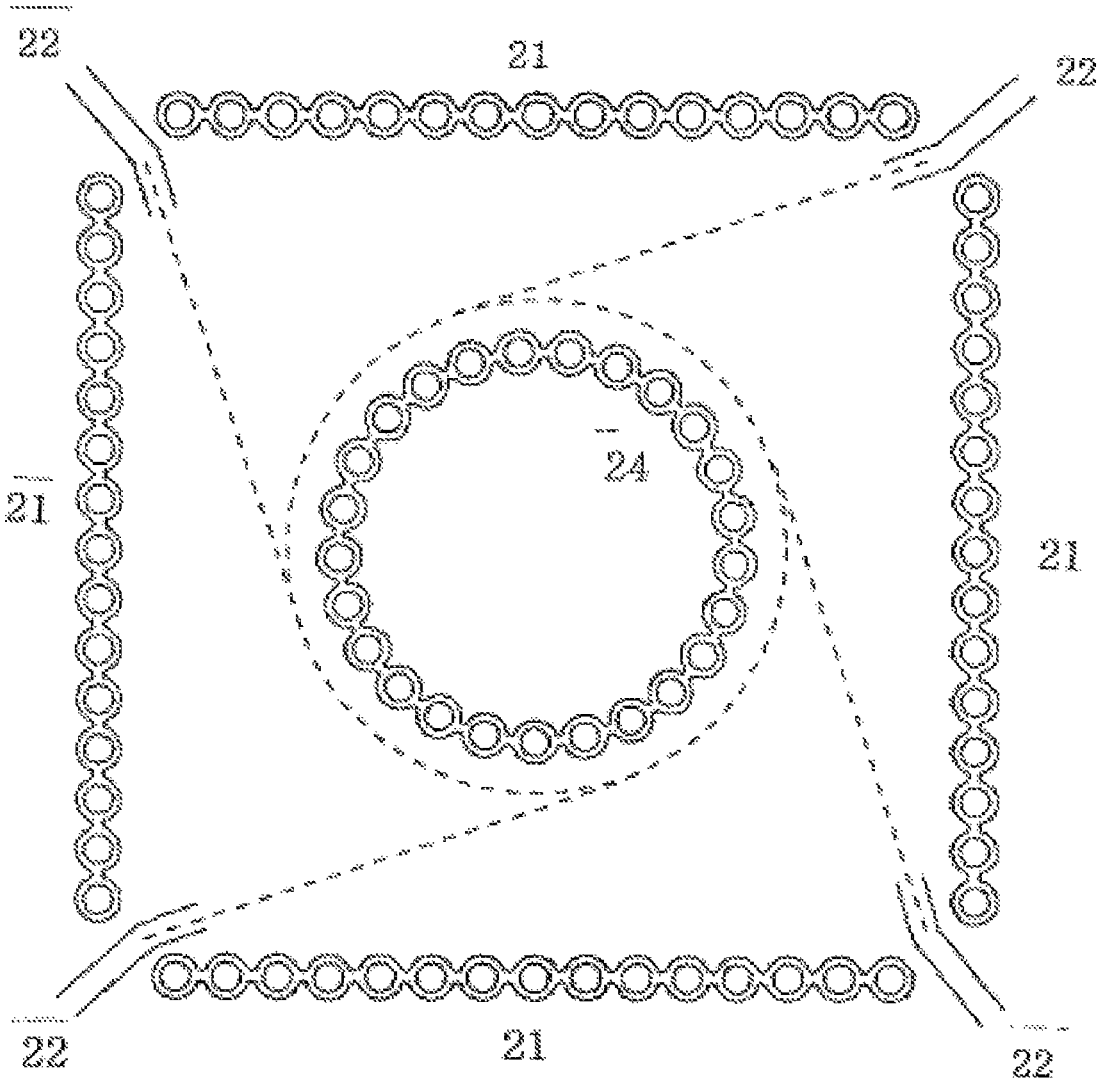

[FIG 9]
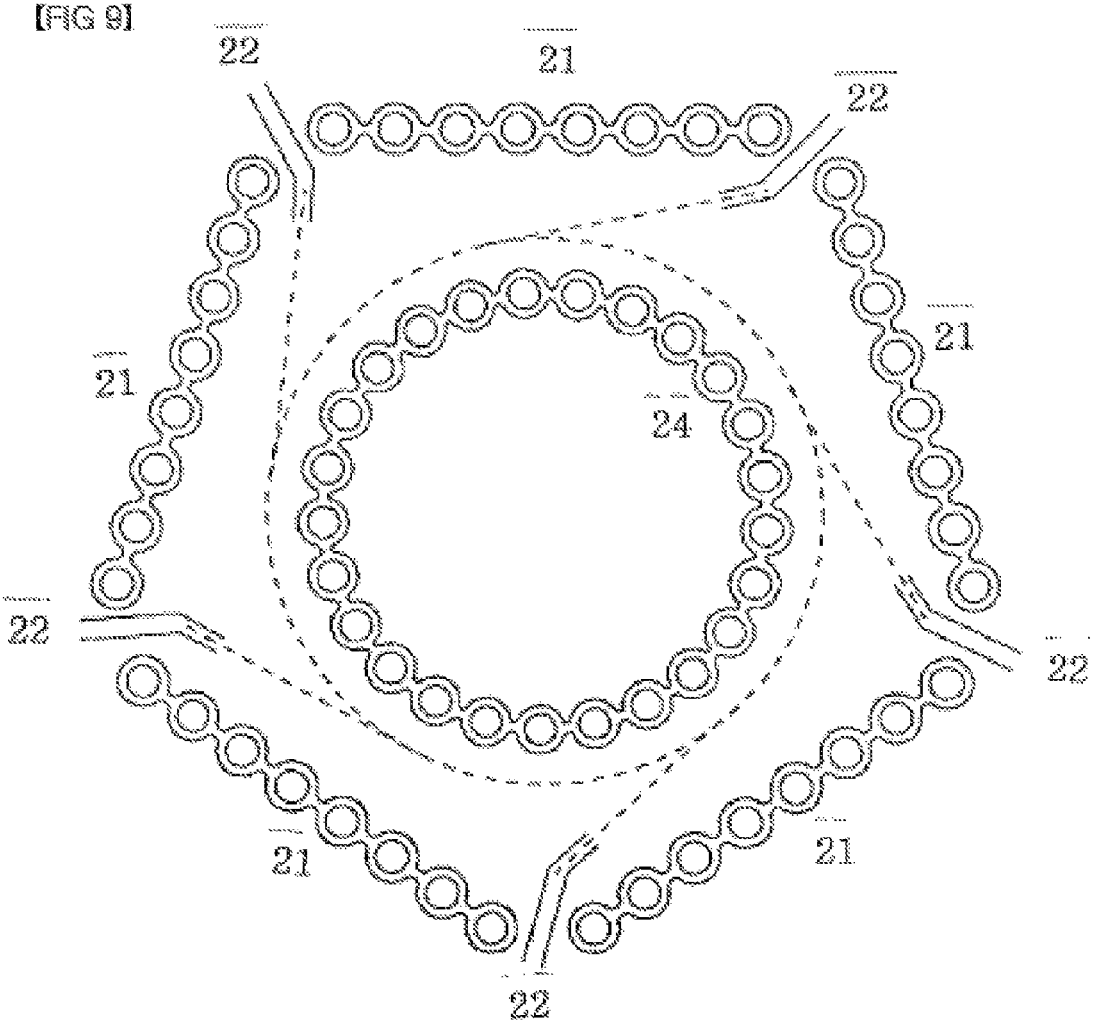

[FIG 10]
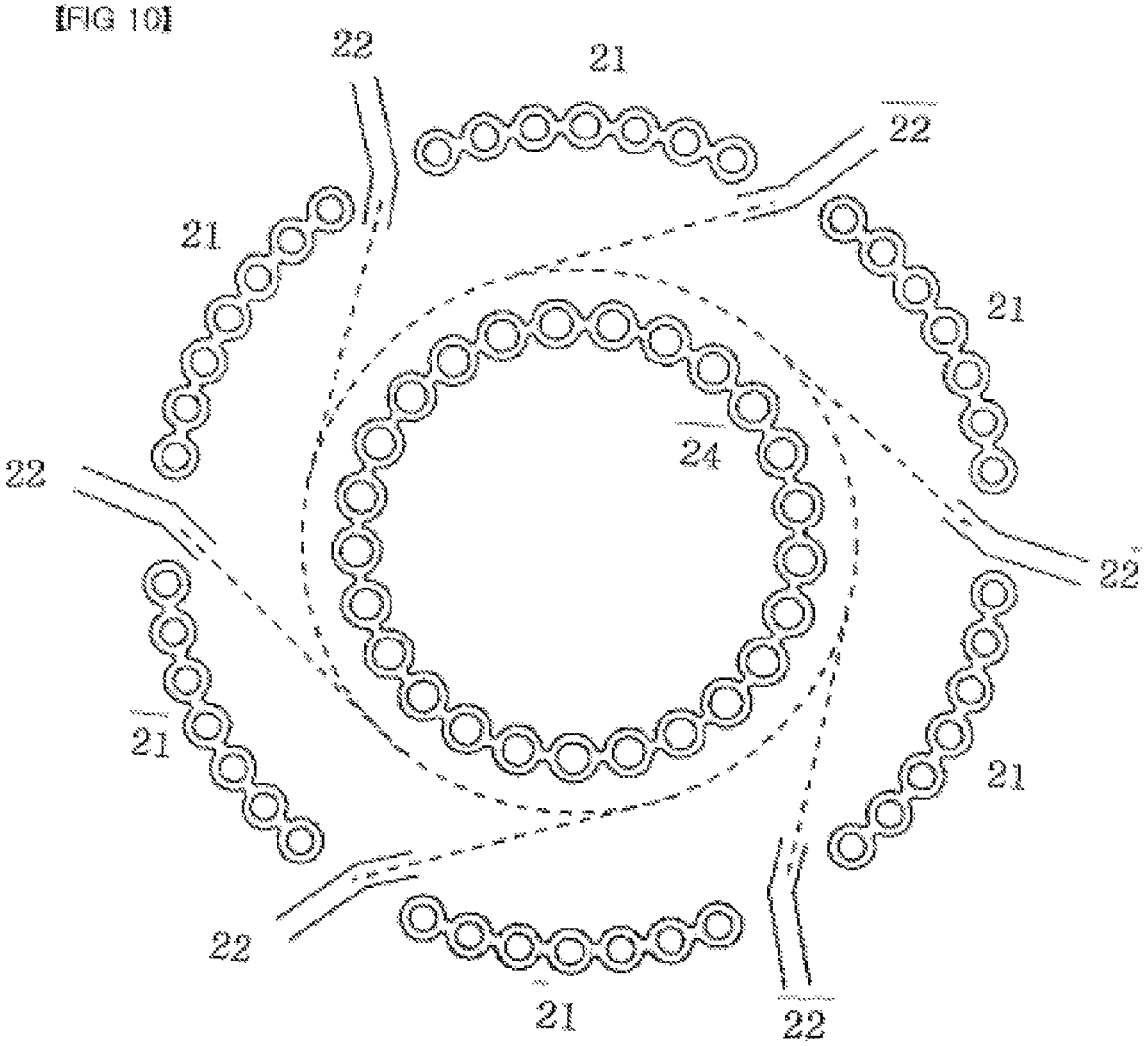

[FIG 11]
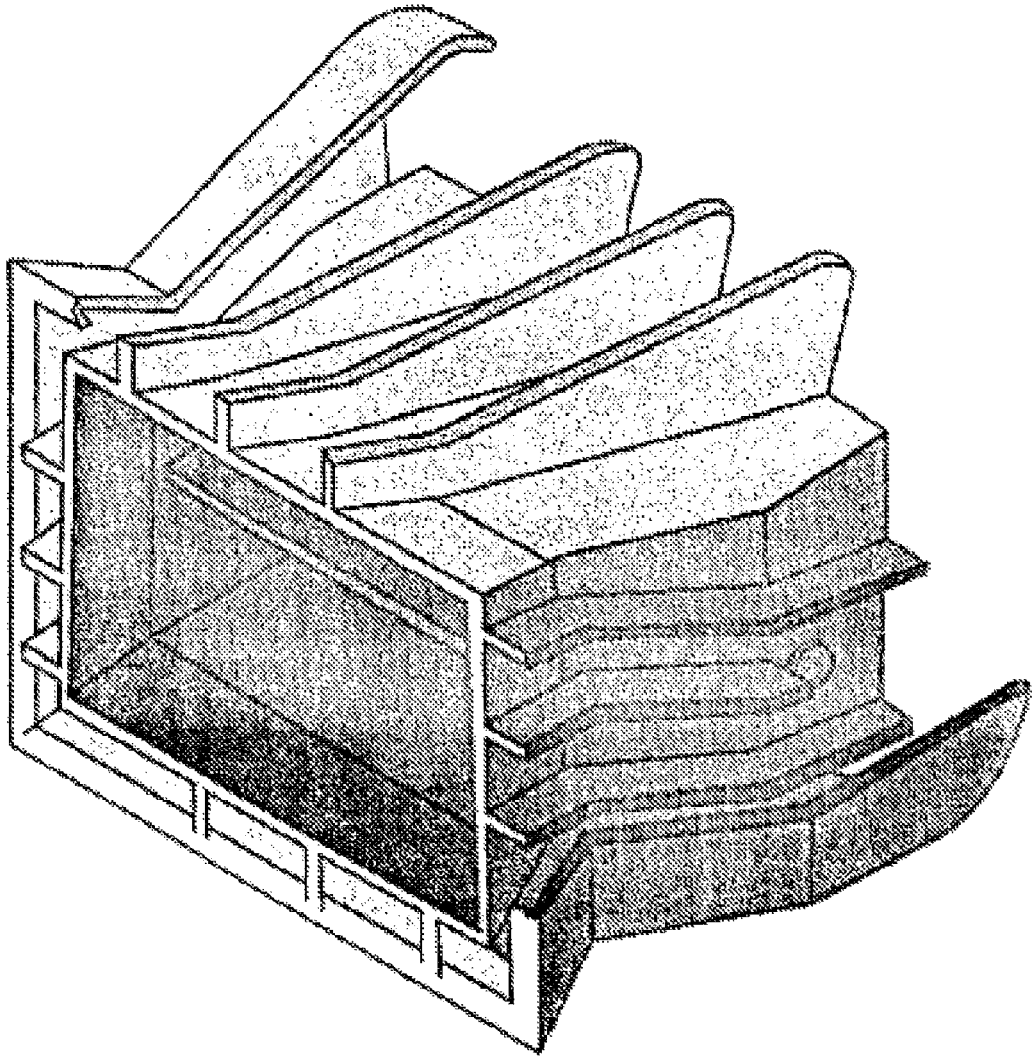

[FIG 12]
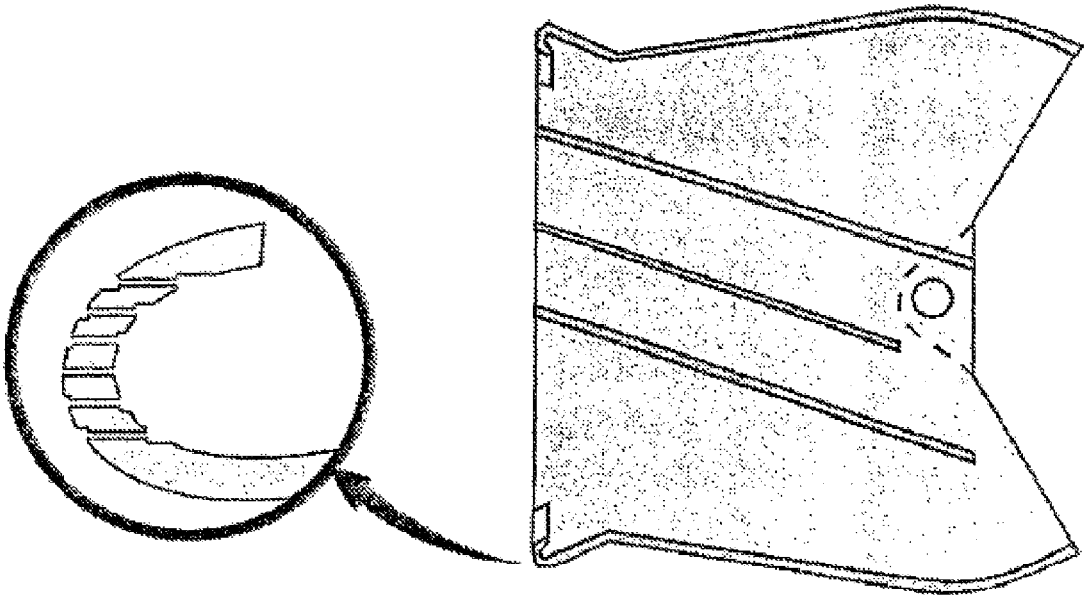

BOILER FURNACE THAT AVOIDS THERMAL NOX

CROSS-REFERENCE TO RELATED APPLICATIONS

This application claims priority to Korean patent application 10-2004-0071483 filed on Sep. 7, 2004, and international patent application PCT/KR2005/002957 filed on Sep. 7, 2005.

TECHNICAL FIELD

The present invention relates to a boiler furnace to generate electricity.

BACKGROUND

Conventional boiler furnaces for making electricity have water walls composed of tubes to contain water and members to connect the tubes. The furnace has a rectangular shape composed of four water walls. The water walls are composed of boiler tubes and connecting members. Each corner has a fuel/air nozzle which injects the mixture of fuel and air into the furnace. For a pulverized coal boiler, the nozzle injects fuel and air at a tangential direction to the assumed position of the fire in the furnace. Some boilers employ a super-heating zone above the furnace to absorb the heat and prevent it from going up the chimney. But the intense fire makes thermal NOx due to a temperature that can exceed 1,000° C. The higher the firing temperature, the more thermal NOx is produced.

SUMMARY

The present invention has been made in an effort to avoid or minimize thermal NOx emissions. Another object of the present invention is to provide a smaller boiler with high thermal efficiency. The boiler furnace according to the present invention includes outer water walls and spray nozzle to inject fuel and air at each corner of water walls is characterized in supplemental water walls which are placed in the space surrounded by outer water walls and are located in the assumed fire ball location. The small space surrounded by supplemental water walls can be utilized as a useful space, like as pre-heater, economizer. Therefore, the boiler furnace of the present invention avoid fire ball and makes low flame temperature, and avoid producing of thermal NOx and provide more heat transferring to water due to preparing of larger contact surface and can lead to small boiler with higher efficiency. The flames in the furnace are surrounded by outer water walls and are reflected by inner water walls to heat the water in the outer water walls. By reflecting the heat between the walls, the thermal energy of the flame is also transferred to the water in the inner water walls. More heat is transferred to the water walls by shortening the distance from the flame to the outer water walls and by the additional heating of the inner water walls. Thermal NOx is reduced by a fire with a lower flame temperature even though it has maximum combustion efficiency.

BRIEF DESCRIPTION OF THE DRAWINGS

FIG. 2 is a perspective view illustrating a first embodiment of the present invention;

FIG. 3 is a perspective view illustrating vertical arrangement of inner water walls and cooling air holes;

FIG. 4 is a perspective view illustrating horizontal arrangement of inner water walls;

FIG. 5 is a perspective view illustrating an arrangement of the inner water walls;

FIG. 6 is a perspective view illustrating an inner water walls;

FIG. 7 is a perspective view illustrating a vertical, intermittent arrangement of inner water walls;

FIG. 8 is a cross-sectional view of the present invention for a rectangular boiler;

FIG. 9 is cross-sectional view of the present invention with polygon-shaped boiler;

FIG. 10 is a cross-sectional view of the present invention for circular-shaped boiler;

FIG. 11 is a perspective view of an eddy fuel-air spray nozzle tip; and

FIG. 12 is a cross-sectional view of the eddy fuel-air spray nozzle tip.

DETAILED DESCRIPTION OF THE INVENTION

The objects to be achieved and the technical problems to be overcome can be solved by the present invention. Eddy blowing nozzles installed at each corner of the furnace spray a fuel-air mixture in a wide pattern near the outer water walls. A flame reflecting structure composed of heat resistant material or a heat resistant water with air holes to inject cooling air protects the inner water walls from the flame are installed at a distance which provides the highest temperature of the reflected flame on the surface of outer water walls. The space between the outer water walls and the inner reflecting structure become a combustion chamber into which fuel and air is injected and makes a fire tunnel which has high temperature and a high density flame and increases the heat transfer to the water walls. The injection angle of the fuel-air mixture from eddy nozzle is tilted from the horizontal to provide tangential access to the center of the flame. The vertical height of the injected fuel-air mixture from the eddy nozzle can be adjusted to control the temperature in the furnace. Cooling air holes of the inner water wall are arranged in a helical distribution with an upward angle causing a spiral-shaped flame motion along the surface of the inner water walls and to pass the super heater zone, economizer, preheater and chimney located above the boiler furnace.

Figure 1A:
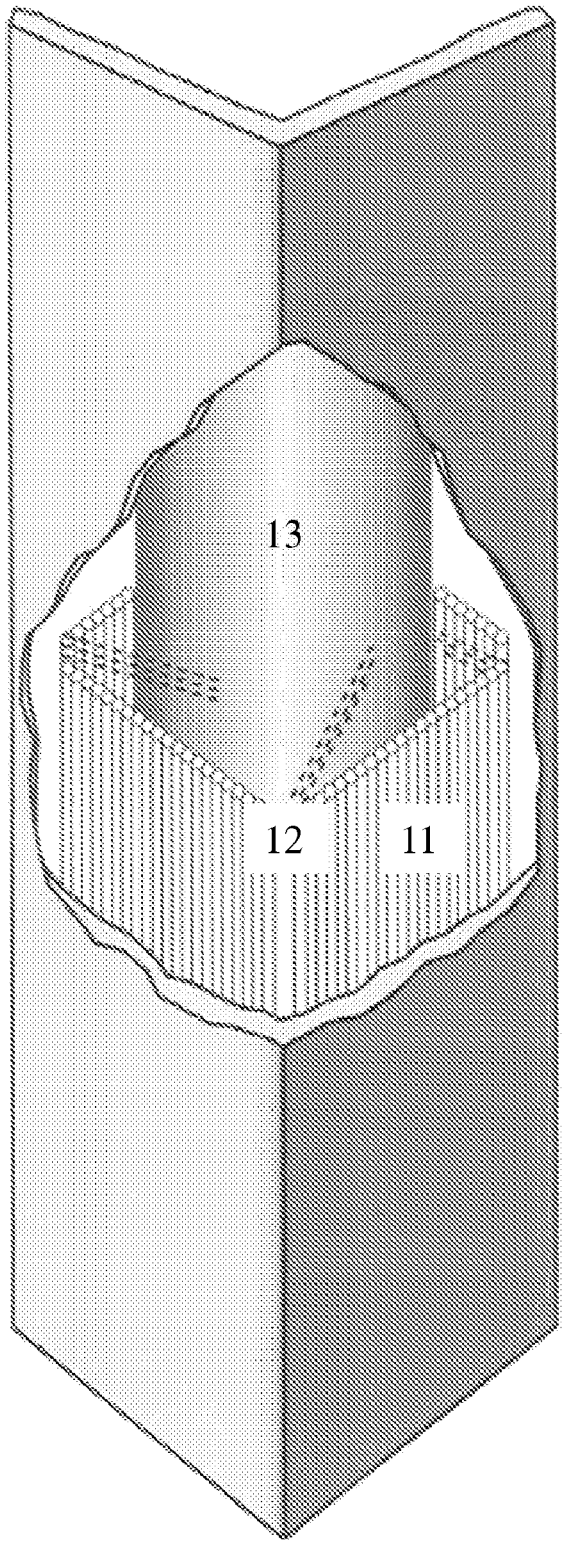
FIG. 1 is a perspective view illustrating one of a conventional pulverized coal boiler furnace.
Figure 1B:
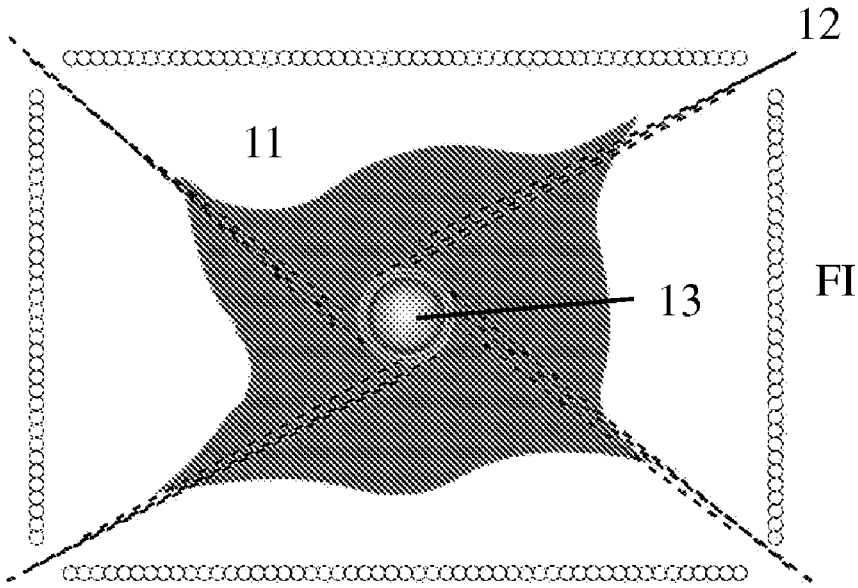
Figure 1C:
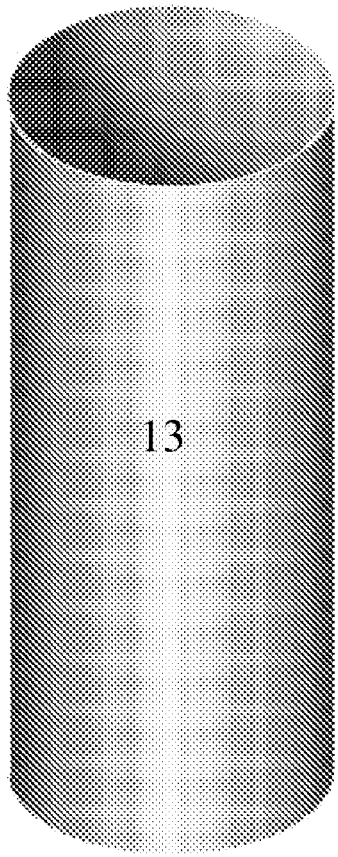

The present invention is explained in more detail in the illustrated examples. FIG. 1 is perspective view illustrating a conventional boiler which includes an outer water wall (11), a fuel-air nozzle tip (12) and a fire ball (13). As shown in FIG. 2, the boiler of the present invention is composed of water walls (21) at the outer boundary and an eddy fuel-air injection nozzle tip (22) at each corner and cylindrical flame reflecting water walls (24) in the center of the combustion room. A more detailed structure of the eddy fuel-air nozzle is explained in FIG. 11 and FIG. 12.

Referring again to FIG. 2, the structure of the water walls for flame reflection can vary depending on the particular configuration, such as, vertical (FIG. 3), horizontal (FIG. 4), helical (FIG. 5), vertical/centrifugal (FIG. 6), vertical/intermittent (FIG. 7) etc. Members of the connecting structure of each water tube have air injecting holes (241) with a helical arrangement. Configuration of air injection holes (241) can vary such as circular, rectangular or an intermittent type between the water walls. Surfaces of water tubes of the water walls (24) are coated by erosion resistant materials and are protected from high temperature erosion by combusted particles mixed with the flame which have high speed impinging energy. Therefore, the space between the outer water walls and the inner water walls becomes a combustion chamber and makes a fire tunnel such that the heat transfer rate is increased due to the wider conducting surfaces within a shorter distance.

An example of the operation of the present invention is explained as follows. The water tubes are filled with water and the inside of the furnace is heated by igniting oil sprayed from the burner. Pulverized coal is sprayed onto the flame through eddy injection nozzle tips (22). Once the coal-fired flame ignites, the oil burner is shut off. As the coal-fired flame grows, auxiliary air come out of the inner water walls (24) in a helical pattern. The auxiliary air moving upward in a helical pattern from the inner water walls (24) causes the flame from the eddy fuel-air nozzle tip (22) to rotate around the inner water walls and become a fire tunnel between two walls, heating the surface of both water walls and increases the heat transferring effect. Thus, the rapid temperature rise of the water result in more steam evaporation. Here, if the outer water walls are have a polygon shape (FIG. 5), rather than rectangular (FIG. 8) or circular (FIG. 10), the flame becomes fire tunnel more easily and becomes more efficient.

In another embodiment, the outer water walls have a refractory structure which reflects the flame instead of inner water walls. This arrangement also increases the flame density and provides shorter heating distance and result in efficiency rising of boiler.

In still another embodiment, the outer water walls have a grid structure which reflects the flame instead of inner water walls. The grid in this arrangement radiates heat and increases boiler efficiency.

The boiler furnace has been described through specific embodiments, but should not be confined or limited to these examples. A person with ordinary knowledge in the field to which the present invention belongs can use the technical concepts to modify the present invention. Thus, the present invention includes the scope of the following claims and its equivalents.

What is claimed is:

1. A boiler furnace, comprising:

a first set of water pipes that define a first vertical wall that surrounds an enclosed space;

a plurality of fuel nozzles attached to the first vertical wall; and a second set of water pipes that define a second vertical wall inside the first vertical wall and coaxial to the first vertical wall, the second set of water pipes having open gaps between at least some of the water pipes, wherein the space between the first vertical wall and the second vertical wall defines a combustion chamber.

2. A boiler furnace with a combustion chamber between a first wall and a second wall, comprising:

a first wall that includes a first set of water pipes and the first wall surrounds an enclosed space; and a second wall inside the first wall, the second wall including a second set of water pipes and connecting members between one or more of the water pipes of the second set of water pipes, the connecting members including air injection holes;

wherein the space between the first wall and the second wall defines the only combustion chamber.

3. The boiler furnace of claim 2, wherein the volume defined within the second wall is configured to provide air flow into the combustion chamber.

4. The boiler furnace of claim 3, wherein the air flows through the air injection holes into the combustion chamber.

* * * * *